United States Patent [19]

Meikrantz

[11] Patent Number: 4,959,158

[45] Date of Patent: Sep. 25, 1990

[54] METHOD FOR SEPARATING DISPARATE COMPONENTS IN A FLUID STREAM

[75] Inventor: David H. Meikrantz, Idaho Falls, Id.

[73] Assignee: The United States of America as represented by the Unitd States Department of Energy, Washington, D.C.

[21] Appl. No.: 330,589

[22] Filed: Mar. 30, 1989

[51] Int. Cl.[5] ..... B04B 11/00

[52] U.S. Cl. ..... 210/787; 494/37; 494/56; 494/901

[58] Field of Search ..... 210/360.1, 360.2, 378, 210/512.1, 515, 781, 787; 494/27, 43, 56, 60, 62, 22, 37, 901

[56] References Cited

U.S. PATENT DOCUMENTS

| | | | |
|---|---|---|---|
| 3,931,928 | 1/1976 | Kido | 494/901 |
| 3,955,757 | 5/1976 | Lowry | 494/22 |
| 4,175,040 | 11/1979 | Sammons et al. | 210/781 |
| 4,501,671 | 2/1985 | Bazell | 210/360.1 |
| 4,525,155 | 6/1985 | Nilsson | 494/901 |
| 4,634,416 | 1/1987 | Ehnstrom | 494/27 |
| 4,687,585 | 8/1987 | Ramshaw | 210/787 |
| 4,816,152 | 3/1989 | Kalleberg | 210/360.2 |
| 4,820,256 | 4/1989 | Nordstrom | 494/27 |
| 4,846,780 | 7/1989 | Galloway et al. | 494/37 |
| 4,857,040 | 8/1989 | Kashihara et al. | 494/60 |

FOREIGN PATENT DOCUMENTS

| | | | |
|---|---|---|---|
| 61-143530 | 6/1986 | Japan | 494/60 |
| 957929 | 9/1982 | U.S.S.R. | 210/787 |
| 1040231 | 9/1983 | U.S.S.R. | 210/360.1 |
| 1269847 | 11/1986 | U.S.S.R. | 494/43 |
| 1398915 | 5/1988 | U.S.S.R. | 494/43 |

OTHER PUBLICATIONS

Ralph A. Leonard et al., "Centrifugal Device Simplifies Cleanup of Nuclear Waste", LOGOS, vol. 5, No. 2, pp. 21 ∝ 7.

Hsien-Wen Hsu, "Separations by Centrifugal Phenomena", Techniques of Chemistry, vol. XVI, pp. 1-15.

*Primary Examiner*—Frank Spear

*Assistant Examiner*—Joseph Drodge

*Attorney, Agent, or Firm*—Thomas G. Anderson; James W. Weinberger; William R. Moser

[57] ABSTRACT

The invention provides a method of separating a mixed component waste stream in a centrifugal separator. The mixed component waste stream is introduced into the separator and is centrifugally separated within a spinning rotor. A dual vortex separation occurs due to the phase density differences, with the phases exiting the rotor distinct from one another. In a preferred embodiment, aqueous solutions of organics can be separated with up to 100% efficiency. The relatively more dense water phase is centrifugally separated through a radially outer aperture in the separator, while the relatively less dense organic phase is separated through a radially inner aperture.

1 Claim, 1 Drawing Sheet

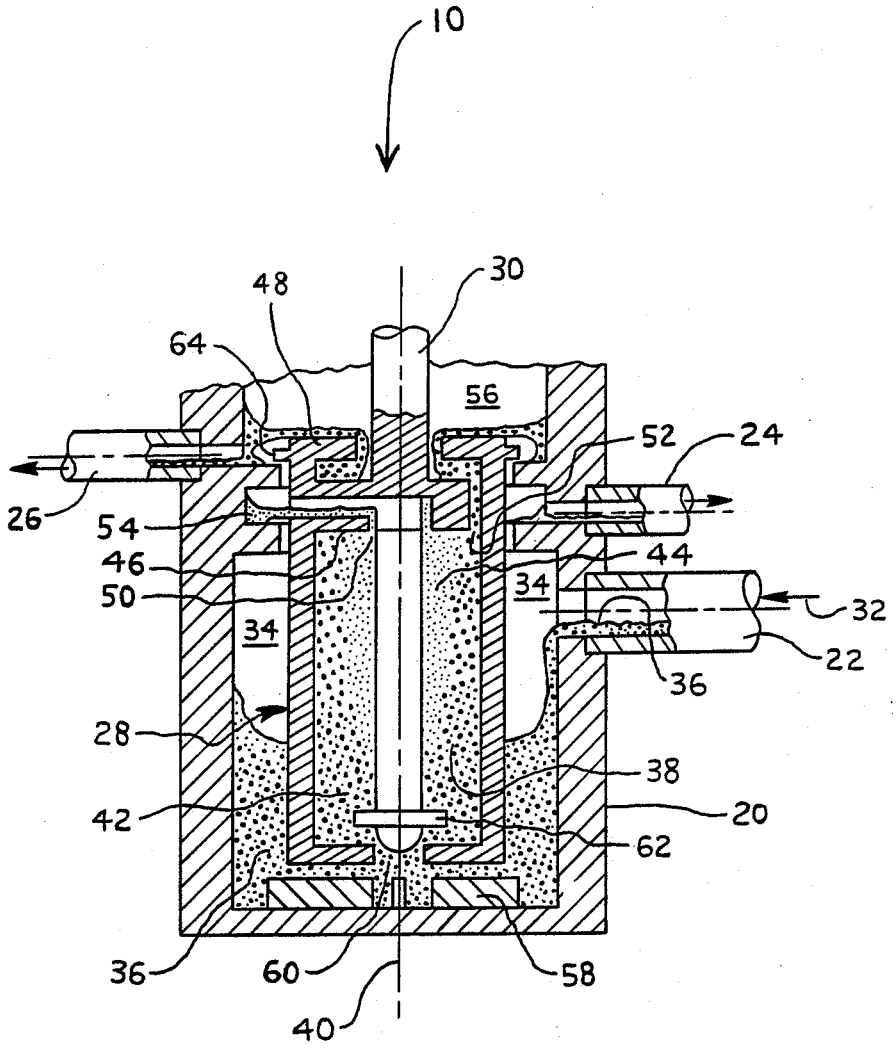
10
30
48
64
56
52
24
26
54
46
50
44
34
32
34
22
36
28
38
42
20
62
36
60
58
40

METHOD FOR SEPARATING DISPARATE COMPONENTS IN A FLUID STREAM

CONTRACTUAL ORIGIN OF THE INVENTION

The U.S. Government has rights in this invention pursuant to Contract No. DE-AC07-88ID10297 between the U.S. Dept. of Energy and EG&G Idaho, Inc.

BACKGROUND OF THE INVENTION

Separation by centrifugal phenomena is based on the transfer of materials from one phase to another by mechanical means utilizing differences in particle density and size in mixtures under an applied centrifugal force field, Centrifugal separators have been used in industrial processes for at least one hundred years, as exemplified by early cream separators. Centrifuges are currently utilized in a broad spectrum of industry, including blood plasma separations, rubber latex concentration, penicillin solvent separation, wine clarification, municipal and industrial waste-water treatment for dewatering sludge, uranium mining, etc. Previously, centrifuges were conventionally classified as either a "settling" centrifuge (wherein particulates are removed by sedimentation) or "filter" centrifuge (wherein a liquid is forced through a filter medium by centrifugal action).

However, a new type of "centrifugal contactor" was developed by the Dept. of Energy in order to extract transuranic (TRU) elements from radioactive waste streams at nuclear processing plants. This device rapidly mixes the water-based nuclear waste in a first stream with a second stream containing an organic solvent that extracts the transuranic wastes. The two streams are individually introduced into a centrifugal contactor and thoroughly mixed such that the organic solvent may extract the TRUs with the centrifugal force applied to the mixture producing a clean separation of the solvent containing the TRUs from the waste water. By repeatedly mixing and separating the two phases, the centrifugal contactor can achieve relatively high levels of nuclear waste purification.

Heretofore, centrifugal contact separators have been used only in an environment exemplified by the nuclear waste separator described above, wherein two disparate fluids are mixed ("contacted") in an annular mixing zone so that an interaction between the two fluids can occur (such as the solvent extraction of transuranic waste from an aqueous waste stream). Such processes require that two separate and distinct fluids be handled, stored, transported and mixed. Such processes, and the apparatus to effect the process, ignore, the potential separation of disparate components already mixed with one another in a fluid system. For example, the separation of oil and water in a ship's bilges, the separation of solvents, fuels or other organic fluids spilled into lakes, streams, rivers or oceans, and any other application where rapid and efficient two-phase separation is desired in a fluid stream, do not necessarily require the addition of a second fluid to effect the separation of the two phases. Selective solvent extraction of a particular heavy metal is well known in, for example, pulsed extraction columns. However, such apparatus' are bulky and are not considered portable.

Therefore, there is a need for a centrifugal separator which can be used in a process wherein a single fluid having disparate components intermixed therein is introduced for separation of the various components, without the need to introduce a second fluid to be intermixed with the first fluid.

SUMMARY OF THE INVENTION

The present invention improves conventional centrifugal separator technology in a novel manner to effect the separation of disparate components in a fluid stream. The apparatus utilized herein comprises a separator having an outer housing, an inlet port and a rotor spinning within the housing. Radially oriented outlet ports adjacent the top of the rotor differentially vent the disparate components of the waste stream, one of which must have a higher specific gravity than the other. The mixed component waste stream is introduced into the housing through the inlet port, and is directed into the base of the rotor. The rotor spins about a longitudinal axis, such that the heavier component of the mixed component waste stream is centrifugally concentrated in the radially outermost portions of the rotor, and the lighter component is concentrated in the radially innermost portions of the rotor. The heavier component as discharged through radially outer outlet ports in the top of the rotor discharge the heavier component, while radially inner outlet ports discharge the lighter component.

BRIEF DESCRIPTION OF THE DRAWINGS

FIG. 1 discloses a longitudinal sectional view of a centrifugal separator used in the method of the present invention.

DETAILED DESCRIPTION OF THE INVENTION

The method of the present invention is preferably practiced with a centrifugal separator specifically modified for this process. As illustrated in FIG. 1, the centrifugal separator, generally designated 10, is shown in longitudinal sectional view through the center of the device. The separator comprises an outer housing 20, at least one waste-stream inlet port 22, at least two outlet ports 24, 26 and a rotor 28 which rotates within the housing 20 about shaft 30. A mixed component waste stream enters the inlet port 22 in the direction of arrow 32 and enters an annular space 34 between the housing 20 and rotor 28. The fluid 36 of the mixed component waste stream is drawn into the separating zone 38 within the rotor 28, wherein the disparate components of the waste stream are separated from one another.

As the rotor 28 spins about shaft 30, the fluid within the annulus 34 is spun about axis 40. Vertical baffles (not shown) within the rotor rapidly accelerate the rising fluid 36 to rotor speed. After entering the separating zone 38, the phases are centrifugally separated into a dual vortex due to their density differences. The denser components 42 are preferentially moved by centrifugal force to the radially outermost portions of the rotor 28, leaving the lighter, less dense components 44 in the radially innermost portion of the rotor 28.

The rotor is provided with two top members, an inner top member 46 and an outer top member 48. The inner top member is provided with apertures especially adapted to preferentially permit the exit of only one of either of the heavier or lighter components 42, 44. Such apertures function as weirs to control the rate of fluid escaping from rotor 28. The lighter components 44 exit the interior of the rotor 28 through apertures 50 located on the radially innermost portion of the inner top member 46. Therefore, as the lighter components are located near the shaft 30, the lighter components exit through the inner apertures 50 whereupon they are directed out of the separator 10 through outlet port 24.

The inner top member 46 is also provided with radially outer apertures 52 adapted to permit the exit from the interior of the rotor 28 of the heavier components 42 which are located radially outwardly from the lighter components 44. The heavier components 42 exit through outer apertures 52 and are directed into chamber 56, whereupon the weirs control flow out of the separator through outlet ports 24 and 26.

In a preferred embodiment, the separator is provided with a plurality of vanes 58 affixed to the bottom of the rotor which reduce the rotational liquid motion induced in the annulus 34 and direct the fluid into the interior of the rotor through a rotor inlet port 60. Fluid entering the rotor through port 60 contacts a diverter disk 62 and is directed uniformly into the separating zone 38. A slinger ring 64 may be provided on the rotor in order to assist the outflow of the heavier component from chamber 56.

Under normal operating conditions, the centrifugal action of the rotor will induce throughput of the fluid wastes through the separator. However, it should be appreciated that if problems occur in maintaining throughput, the fluid entering inlet port 22 may be pressurized, or the holding tanks for the output of outlet ports 24, 26 may be evacuated thereby assisting throughput through the rotor. It is also to be appreciated that the separator of this invention may be operated with a single-inlet port, or a plurality of inlet ports if required to maintain sufficient charging of the rotor. Because the fluid to be separated is already admixed, it is believed that a single inlet port will, in most cases, be sufficient.

EXAMPLE 1

A separator as described above and illustrated in FIG. 1 was utilized to test the efficiency of separating disparate components from a mixed component waste stream. The separator housing was made of clear plastic to permit visual verification that the annulus between the housing and the rotor was properly flooded. An organic (#1 diesel fuel) and with water were pumped into the separator using positive displacement piston pumps from Fluid Metering Inc. Total flow rates did not exceed 80 cc/min. Various flow ratios were tested by varying the pumping rate of a single pump while the separator ran at equilibrium. Rotor speed was maintained at 2,900 rpm. Bromcresol green (0.04%) indicator solution was added to the water to enhance visual detection of phase cross-contamination. Visual standards were prepared ranging from 1% to 5% diesel fuel in water, and 1% to 5% water in diesel fuel. The standards were used as the basis for visual estimates of phase separation by the separator. The ratio of diesel fuel to water was adjusted over a range of 10:1 to 1:10. The results of this experiment are set forth in Table 1.

TABLE 1

| Organic/Water Ratio | Flow Rate cc/min. | Visual Phase Purity % | |
|---|---|---|---|
| | | Water | Organic |
| 10 | 44 | 100 | 90 |
| 5 | 48 | 100 | 95 |
| 3.3 | 52 | 100 | 98 |

TABLE 1-continued

| Organic/Water Ratio | Flow Rate cc/min. | Visual Phase Purity % | |
|---|---|---|---|
| | | Water | Organic |
| 2.5 | 56 | 100 | 98 |
| 2.0 | 60 | 100 | 98 |
| 0.1 | 44 | 100 | 100 |
| 0.2 | 48 | 100 | 100 |
| 0.4 | 56 | 100 | 100 |
| 0.75 | 70 | 100 | 95 |
| 0.9 | 76 | 100 | 98 |
| 1 | 80 | 100 | 98 |

EXAMPLE 2

An experiment similar to that of Example 1 was conducted except that S.A.E. 30-30W motor oil was used rather than diesel fuel in order to evaluate the separator efficiency when separating higher viscosity organics. Rotor speed was lowered to 1,900 rpm and total throughput rates were maintained at 40 cc/min. Equilibrium was rapid and stable throughout various ratios of motor oil:water. However, the detergent additives in the motor oil caused some irreversible emulsification which made estimates of separation efficiency difficult.

EXAMPLE 3

An experiment similar to that of Example 2 was conducted using a standard grade mechanical vacuum pump oil rather than detergent motor oil. The viscosity of this fluid was not labelled, however the advertised pour point was −15° C. The visual appearance was somewhat less viscous than S.A.E. 30-30W motor oil at room temperature. At rotor speeds of 1,800-2,400 rpm and flow rates of 40 cc/min, the oil and water were successfully separated with very little visual contamination of one phase by the other. Ratios of pump oil to water were varied from 1:4 to 4:1 with no apparent loss of contactor equilibrium.

While a preferred embodiment of the invention has been disclosed, various modes of carrying out the principles disclosed herein are contemplated as being within the scope of the following claims. Therefore, it is understood that the scope of the invention is not to be limited except as otherwise set forth in the claims.

I claim:

1. A method of centrifugally separating disparate components in a separator having a housing, a waste-stream inlet port, a rotor spinning within said housing, a separating zone within said rotor, and radially oriented outlet apertures adjacent the top of the rotor to differentially permit the exit of the disparate components from said rotor, the improvement comprising:

introducing a mixed component waste stream radially into the separator housing through at least one waste-stream inlet port and into an annular space surrounding and adjacent to said rotor, the mixed component waste stream comprising a mixture of water and a water insoluble hydrocarbon petroleum-based product selected from the group consisting of gasoline, diesel fuel, crude oil, motor oil and pump oil;

discharging the water of the mixed component waste stream radially from a radially outward outlet aperture in the top of said rotor and discharging the petroleum-based product of the mixed component waste stream radially from a radially inward outlet aperture in the top of said rotor; and controlling the rate of component discharge from the separator by utilizing the apertures as weirs.

* * * * *